US009381387B2

(12) United States Patent
Douglas

(10) Patent No.: US 9,381,387 B2
(45) Date of Patent: Jul. 5, 2016

(54) FIRE-PROTECTION MECHANISM

(71) Applicant: David C. Douglas, Palo Alto, CA (US)

(72) Inventor: David C. Douglas, Palo Alto, CA (US)

(73) Assignee: David C. Douglas, Palo Alto, CA (US)

( * ) Notice: Subject to any disclaimer, the term of this patent is extended or adjusted under 35 U.S.C. 154(b) by 108 days.

(21) Appl. No.: 13/999,917

(22) Filed: Apr. 2, 2014

(65) Prior Publication Data

US 2015/0068776 A1 Mar. 12, 2015

Related U.S. Application Data

(60) Provisional application No. 61/959,966, filed on Sep. 7, 2013.

(51) Int. Cl.

| | |
|---|---|
| ***A62C 2/06*** | (2006.01) |
| ***A62C 2/10*** | (2006.01) |
| ***A62C 3/02*** | (2006.01) |

(52) U.S. Cl.

CPC ..... *A62C 3/0264* (2013.01); *A62C 3/0214* (2013.01)

(58) Field of Classification Search

CPC .. A62C 3/0257; A62C 3/0264; A62C 3/0214; A62C 2/06; A62C 2/065; A62C 2/10

USPC ..... 169/45, 48, 49, 54; 442/301, 302; 428/920, 921

See application file for complete search history.

(56) References Cited

U.S. PATENT DOCUMENTS

| | | | | |
|---|---|---|---|---|
| 2,340,370 | A * | 2/1944 | Doyle | A62C 8/06 169/50 |
| 3,008,214 | A | 11/1961 | Foster et al. | |
| 3,548,904 | A * | 12/1970 | Mackell | B65D 88/14 206/522 |
| 3,715,843 | A * | 2/1973 | Ballinger | E04B 1/945 52/3 |

(Continued)

FOREIGN PATENT DOCUMENTS

| | | |
|---|---|---|
| AU | 2003203725 | 8/2004 |
| AU | 2004201734 | 11/2004 |

(Continued)

OTHER PUBLICATIONS

Sunseeker Fire Blanket, Feb. 25, 2014 at http://www.sunseekerfireblanket.com/.

(Continued)

*Primary Examiner* — Arthur O Hall
*Assistant Examiner* — Joseph A Greenlund
(74) *Attorney, Agent, or Firm* — Steven Stupp

(57) ABSTRACT

A fire-protection mechanism is described. The fire-protection mechanism includes multiple, overlapping cavities that can be filled with water (and, more generally, a fluid). When the fire-protection mechanism is deployed over an object, such as a building, and the cavities are filled with water, the fire-protection mechanism reduces the likelihood that the object is damaged by the heat associated with a fire proximate to the object, such as a wild fire. In particular, the heat capacity and latent heat of the water significantly increase the thermal time constant of the object, thereby reducing the likelihood of combustion. The fire-protection mechanism may include a reflective coating to redirect infrared radiation away from the object to provide further protection. In addition, the water in the cavities may be refilled, as needed, by directing a stream of water onto the fire-protection mechanism and/or through an internal channel in the fire-protection mechanism.

20 Claims, 6 Drawing Sheets

(56) References Cited

U.S. PATENT DOCUMENTS

| | | | | |
|---|---|---|---|---|
| 3,960,216 | A | 6/1976 | Islobe | |
| 5,944,114 | A | 8/1999 | Farley | |
| 6,125,941 | A | 10/2000 | Lokken | |
| 6,358,591 | B1 | 3/2002 | Smith | |
| 6,521,362 | B2 * | 2/2003 | Koeppen | B32B 1/08 169/46 |
| 6,742,305 | B2 | 6/2004 | Rogers et al. | |
| 7,225,882 | B2 * | 6/2007 | Miller | A62C 2/10 169/45 |
| 7,568,528 | B1 | 8/2009 | Miller et al. | |
| 7,673,696 | B1 | 3/2010 | Gunn | |
| 7,717,187 | B1 * | 5/2010 | Miller | A62C 2/10 169/45 |
| 7,866,101 | B2 | 1/2011 | Boggs, Jr. | |
| 7,909,111 | B1 | 3/2011 | Hinojosa et al. | |
| 8,151,898 | B2 * | 4/2012 | Merchant | A62C 3/02 169/45 |
| 8,403,070 | B1 * | 3/2013 | Lowe | A62C 3/0257 169/16 |
| 8,844,641 | B2 * | 9/2014 | Peltz | A62C 2/065 169/48 |
| 8,875,802 | B2 * | 11/2014 | Jesclard, Jr. | A62C 8/06 169/48 |
| 2005/0051345 | A1 * | 3/2005 | Calderwood | A62C 8/06 169/49 |
| 2005/0118383 | A1 | 6/2005 | Cargill et al. | |
| 2005/0126794 | A1 | 6/2005 | Palmer et al. | |
| 2005/0170725 | A1 | 8/2005 | Kimener | |
| 2006/0113403 | A1 | 6/2006 | Aamodt | |
| 2011/0127052 | A1 * | 6/2011 | Stuhlbacher | A62C 3/06 169/48 |
| 2011/0226497 | A1 | 9/2011 | Yamodo | |
| 2012/0145418 | A1 | 6/2012 | Su | |
| 2012/0227990 | A1 | 9/2012 | Burnham | |
| 2013/0318886 | A1 * | 12/2013 | Hester | E04H 9/14 52/2.26 |

FOREIGN PATENT DOCUMENTS

| | | |
|---|---|---|
| AU | 2011100088 | 3/2011 |
| DE | 101786 | 2/1899 |
| EP | 2110506 | 10/2009 |
| GB | 2360703 | 3/2000 |
| GB | 2389310 | 6/2003 |

OTHER PUBLICATIONS

Fireproof House?, Feb. 27, 2014 at http://firedaily.com/2010/03/04/fireproof-house.

Firezat Fire Shield Information, Feb. 27, 2014 at http://www.firezat.com/info.html.

International Search Report, PCT/US 14/00188, Dec. 19, 2014.

* cited by examiner

FIRE-PROTECTION MECHANISM

CROSS REFERENCE TO RELATED APPLICATION

This application claims priority under 35 U.S.C. §119(e) to U.S. Provisional Application Ser. No. 61/959,966, entitled "Fire-Protection Mechanism," by David C. Douglas, filed on Sep. 7, 2013, the contents of which are herein incorporated by reference.

BACKGROUND

The present disclosure generally relates to fire protection. More specifically, the present disclosure relates to devices that protect objects from damage or combustion when exposed to fire.

In the presence of a well-developed fire (such as a wild fire in a remote area or a building fire in an urban area), structures often join the main conflagration from ignition because of one or more factors. For example, ignition of the structures may be caused by: sparks and burning cinders being blown onto them, by spontaneous ignition due to their being superheated to an ignition point (such as due to absorption of infrared radiation), and/or by engulfment by the main fire.

The primary technique for preventing ignition of structures in the case of wild fires is prevention. For example, local ordinances often require the clearing of brush, weeds, trees, free wood and other combustibles in areas around structures in rural or fire-prone areas.

Once a wild fire is established, evacuations are generally ordered for areas in the path of the fire, and fire prevention and suppression is turned over to trained firefighting crews. In the case of wild fires, the firefighting crews often use dropped fire retardants, aerial water drops, fire lines and other techniques to extinguish fires.

As a wild fire approaches structures, the firefighting crews create fire lines (i.e., areas that are devoid of combustible materials) to keep the encroaching fires at a distance in an attempt to prevent secondary ignition. When water or fire-retardant chemicals are available, the firefighting fire crews will also treat the structures (and the surrounding areas) with the water or the fire-retardant chemicals to prevent secondary ignition.

One of the last defensive techniques is to directly apply water to the structures so that, if secondary ignition occurs because of sparks or rising temperatures, the fire is suppressed at the time of ignition. However, in the event of restrictions on resources or a low probability of successful fire control, structures may be abandoned to the flames.

In the cases of urban fires, firefighting crews principally use water to control the ignition of adjacent buildings. As in the case of the wild fires, the water is liberally and continuously applied.

In each of these scenarios, preventing secondary ignition of structures involves the commitment of resources, in terms of manpower and water. Because these resources are often limited, these firefighting efforts represent a major drain on resources and can complicate firefighting efforts. In addition, in the event that the firefighting efforts are unsuccessful, there is a considerable burden in terms of lost property, financial and emotional damage, and loss of life.

Hence, there is a need for improved an improved technique for protecting structures (and, more generally, objects) from fire.

SUMMARY

The disclosed embodiments relate to a fire-protection mechanism. This fire-protection mechanism includes a first flexible layer having an outer surface and an inner surface, where the first flexible layer includes openings, defined by edges, between the outer surface and the inner surface, which are distributed over the outer surface. Moreover, the fire-protection mechanism includes a second flexible layer having an outer surface and an inner surface, where the second flexible layer is mechanically coupled to the first flexible layer to form pockets with partially enclosed cavities, defined by the inner surface of the first flexible layer, the inner surface of the second flexible layer, and the openings. The openings allow fluid to flow into and fill the cavities, which are designed to hold the fluid based on gravity, e.g., gravity may hold the fluid in the cavities. (However, in other embodiments the fluid may not be held in the cavities by gravity.) The static presence of the fluid in the cavities may provide fire protection based on the heat capacity and the latent heat of the fluid.

For example, the mechanical coupling may include: a thermal weld, an adhesive, and/or double-stick tape.

Furthermore, the fire-protection mechanism may include internal channels, located between the inner surface of the first flexible layer and the inner surface of the second flexible layer, which couple the pockets. These internal channels may distribute the fluid among the pockets. For example, the internal channels may couple pockets along columns in a vertical direction of the fire-protection mechanism so that the fluid is distributed among the pockets in a given column. Alternatively or additionally, the internal channels may couple pockets along rows in a horizontal direction of the fire-protection mechanism so that the fluid is distributed among the pockets in a given row.

In some embodiments, the pockets are arranged in rows along the horizontal direction, and adjacent rows partially overlap to form a tiled arrangement of pockets. For example, the first flexible layer and the second flexible layer may be subdivided into segments along the rows. Segments of the first flexible layer corresponding to adjacent rows may be mechanically coupled, and segments of the second flexible layer corresponding to adjacent rows may be mechanically coupled.

The fire-protection mechanism can be disposed on an object (and, thus, the fire-protection mechanism may include features that allow the fire-protection mechanism to be disposed on the object). Consequently, the fire-protection mechanism may include anchoring features proximate to edges of the first flexible layer and the second flexible layer.

Note that a width of a given pocket along the horizontal direction may be smaller than a length of the given pocket along the vertical direction. Additionally, at least some of the pockets may have different aspect ratios between widths of the pockets along the horizontal direction and lengths of the pockets along the vertical direction. In some embodiments, aspect ratios, between the widths of the pockets along the horizontal direction and the lengths of the pockets along the vertical direction, vary over the fire-protection mechanism. Furthermore, the sizes of the pockets may vary over the fire-protection mechanism.

Moreover, the fire-protection mechanism may include an internal channel, located between the inner surface of the first flexible layer and the inner surface of the second flexible layer, along a midline of the fire-protection mechanism. The fire-protection mechanism can couple to an external source of the fluid, and the internal channel may convey the fluid to refill the cavities. Furthermore, the first flexible layer may include holes, defined by edges, between the inner surface of the first flexible layer and the outer surface of the first flexible layer, and the holes may overlap with the internal channel.

In some embodiments, the first flexible layer includes pleat features that allow the cavities to expand when the pockets are filled with the fluid. Moreover, the fire-protection mechanism may include overflow features so that the fluid draining from an opening of a pocket that is above another pocket, along the vertical direction, is directed to the opening of the other pocket. Furthermore, the fire-protection mechanism may include an absorbing material in the cavities, which may keep the openings open, allowing the fluid to fill the cavities.

Additionally, the fire-protection mechanism may include external channels, located outside of the outer surface of the first flexible layer and the outer surface of the second flexible layer, which couple the openings of at least a subset of the pockets. These external channels may distribute the fluid among at least the subset of the pockets.

Note that the fire-protection mechanism may include lips, proximate to the openings, which guide the fluid into the pockets. Moreover, the fire-protection mechanism may include support features proximate to corners of the openings. Furthermore, the fire-protection mechanism may include a reflective coating disposed on the outer surface of the first flexible layer. This reflective coating may reflect light having wavelengths in the infrared, which may maintain a temperature of the fluid.

Another embodiment provides a method for protecting an object using the fire-protection mechanism.

Another embodiment provides a method for fabricating the fire-protection mechanism.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Embodiments of a fire-protection mechanism, a technique for protecting an object using the fire-protection mechanism, and a technique for fabricating the fire-protection mechanism are described. The fire-protection mechanism includes multiple, overlapping cavities that can be filled with water (and, more generally, a fluid). When the fire-protection mechanism is deployed over an object, such as a building, and the cavities are filled with water, the fire-protection mechanism reduces the likelihood that the object is damaged by the heat associated with a fire proximate to the object, such as a wild fire. In particular, the heat capacity and latent heat of the water significantly increase the thermal time constant of the object, thereby reducing the likelihood of combustion due to sparks or heat. The fire-protection mechanism may include a reflective coating to redirect infrared radiation away from the object to provide further protection, e.g., by maintaining a temperature of the fluid. In addition, the water in the cavities may be refilled, as needed, by directing a stream of water onto the fire-protection mechanism and/or through an internal channel in the fire-protection mechanism.

By reducing the likelihood that the object is damaged by the fire, the fire-protection mechanism may significantly reduce the cost, both financial and emotional, associated with fires. The fire-protection mechanism may also allow fire fighters to divert scarce resources away from protecting structures, such as buildings, which may allow more fire fighters to fight the fire. In addition to providing added flexibility in fighting a fire, the fire-protection mechanism may also reduce the risks to fire fighters, because fewer fire fighters may need to be put at risk while trying to protect property. Consequently, the fire-protection mechanism may provide a low-cost and efficient way for property owners and fire fighters to protect objects from damage, while reducing the associated risk and expense associated with fires.

Figure 1:
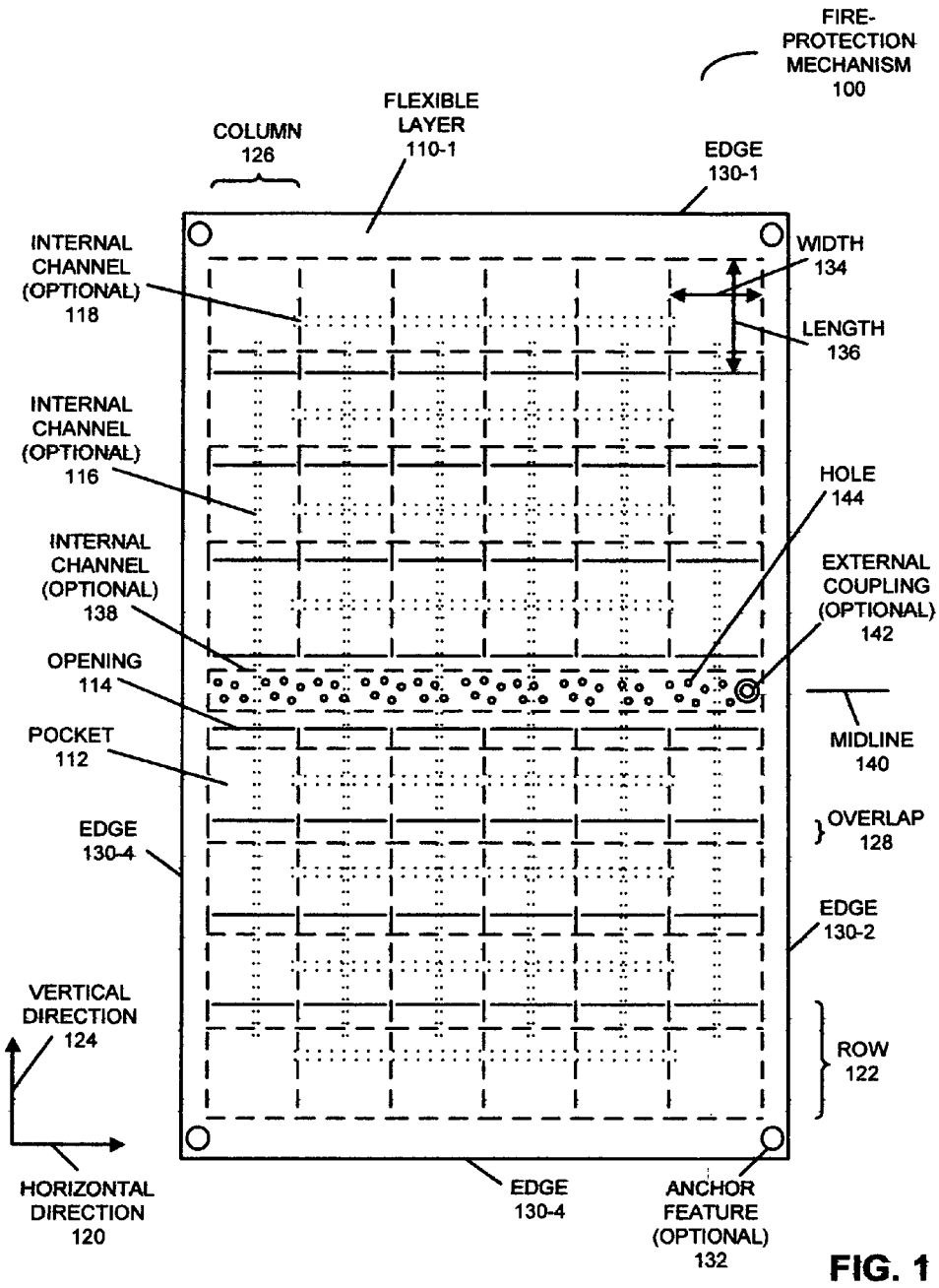
FIG. 1 is a block diagram illustrating a top view of a fire-protection mechanism in accordance with an embodiment of the present disclosure.
Figure 2:
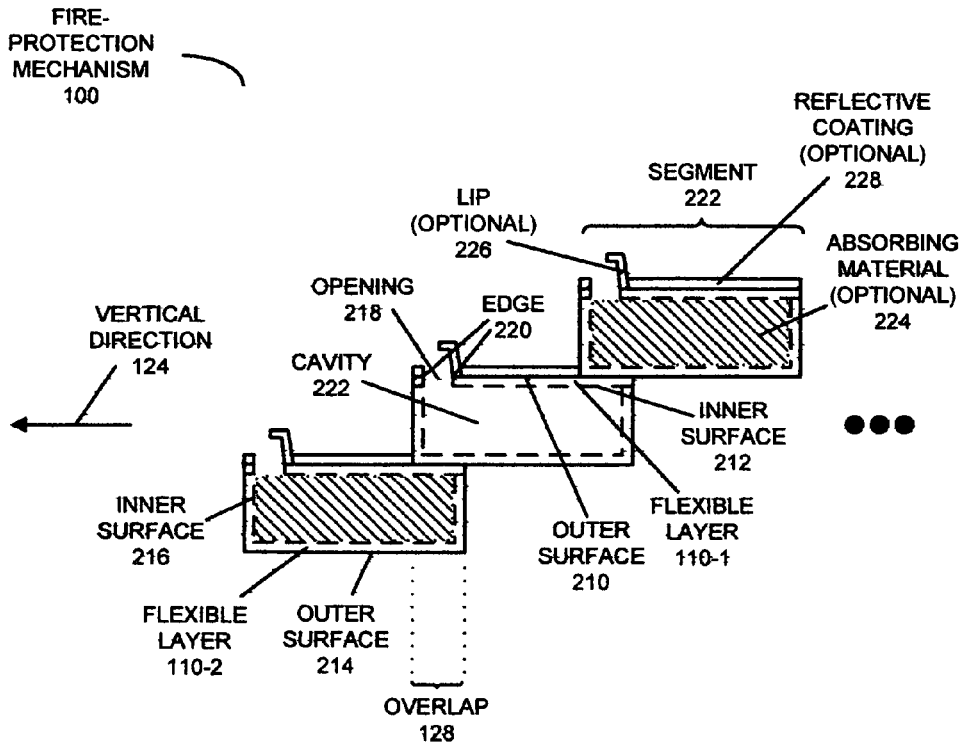
FIG. 2 is a block diagram illustrating a side view of the fire-protection mechanism of FIG. 1 in accordance with an embodiment of the present disclosure.

We now describe embodiments of the fire-protection mechanism. FIG. 1 presents a block diagram illustrating a top view of a fire-protection mechanism 100. This fire-protection mechanism includes a flexible layer 110-1 (such as a plastic sheet). As shown in FIG. 2, which presents a block diagram illustrating a side view of fire-protection mechanism 100, flexible layer 110-1 has an outer surface 210 and an inner surface 212, where flexible layer 110-1 includes openings (such as opening 114 in FIG. 1 or opening 218), defined by edges (such as edge 220), between outer surface 210 and inner surface 212, which are distributed over outer surface 210. Moreover, fire-protection mechanism 100 includes flexible layer 110-2 (such as a plastic sheet) having an outer surface 214 and an inner surface 216, where flexible layer 110-2 is mechanically coupled to flexible layer 110-1 to form pockets (such as pocket 112 in FIG. 1) with partially enclosed cavities (such as cavity 222) defined by inner surface 212, inner surface 216, and the openings. For example, the mechanical coupling may include: a thermal weld, an adhesive, and/or double-stick tape. As illustrated further below with reference to FIG. 7, note that the openings allow fluid (such as water, a fluid that includes a fire-retardant chemical, etc.) to flow into and fill the cavities, which are designed to hold the fluid (e.g., for a length of time, such as hours or days) based on gravity (e.g., gravity may hold the fluid in the cavities). The static presence of the fluid in the cavities may provide fire protection based on the heat capacity and the latent heat of the fluid.

Referring back to FIG. 1, fire-protection mechanism 100 may include optional internal channels 116 and/or 118, located between inner surface 212 (FIG. 2) of flexible layer 110-1 and inner surface 216 (FIG. 2) of flexible layer 110-2, which couple the pockets. These internal channels may distribute the fluid among the pockets. For example, internal channels 116 may couple pockets along columns (such as column 126) in a vertical direction 124 of fire-protection mechanism 100 so that the fluid is distributed among the pockets in a given column. Alternatively or additionally, internal channels 118 may couple pockets along rows (such as row 122) in a horizontal direction 120 of fire-protection mechanism 100 so that the fluid is distributed among the pockets in a given row. In some embodiments, optional internal channels 116 and/or 118 are made of an additional or a separate material than flexible layers 110, such as tubes or hoses.

Note that a width 134 of a given pocket along horizontal direction 120 may be smaller than a length 136 of the given pocket along vertical direction 124. Additionally, at least some of the pockets may have different aspect ratios between widths of the pockets along horizontal direction 120 and lengths of the pockets along vertical direction 124. In some embodiments, aspect ratios, between the widths of the pockets along horizontal direction 120 and the lengths of the pockets along vertical direction. 124, vary over fire-protection mechanism 100. For example, pockets near midline 140 of fire-protection mechanism 100 may have smaller aspect ratios than pockets near edges 130-1 and 130-4 of fire-protection mechanism 100.

Figure 6:
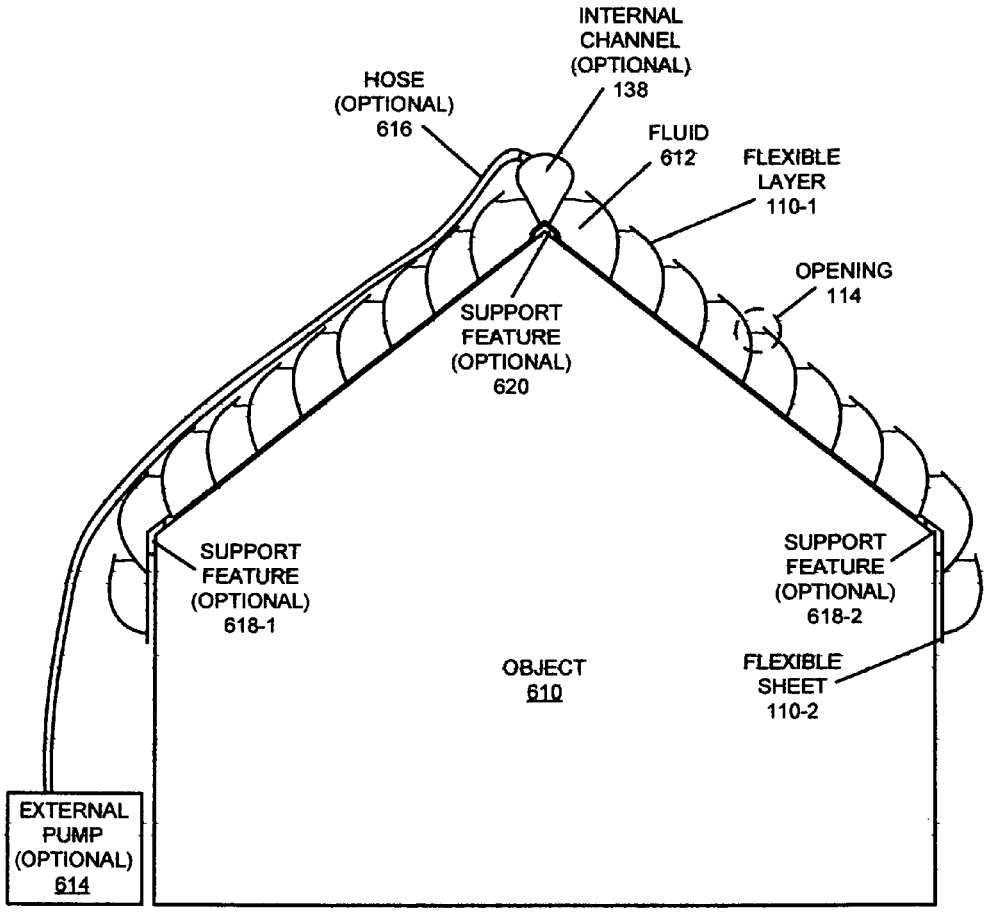
FIG. 6 is a block diagram illustrating a cross-sectional side view of protecting an object using a fire-protection mechanism in accordance with an embodiment of the present disclosure.

Moreover, fire-protection mechanism 100 may include an optional internal channel 138, located between inner surface 212 (FIG. 2) and inner surface 216 (FIG. 2), along or proximate to midline 140. As shown in FIG. 6, fire-protection mechanism 100 can couple to an external source of the fluid (such as a pump) using optional external coupling 142, and internal channel 138 may convey the fluid to refill the cavities. Note that an internal pressure of the fluid in fire-protection mechanism 100 may be low, such as at or near atmospheric pressure (thus, the fluid may be passively conveyed in fire-protection mechanism 100). Furthermore, flexible layer 110-1 may include holes (such as hole 144), defined by edges, between inner surface 212 (FIG. 2) and outer surface 210 (FIG. 2), and the holes may overlap with internal channel 138. The fluid may flow out of the holes, over outer surface 212 (FIG. 2) and into the openings to fill the cavities in the pockets. Alternatively or additionally, a stream of fluid may be directed onto outer surface 212 (FIG. 2) in order to fill the cavities in the pockets. For example, a stream of water from a hose may be sprayed on outer surface 212 (FIG. 2) to fill and/or to refill the cavities in the pockets (such as the water that has leaked and/or evaporated from the cavities).

Referring back to FIG. 2, the pockets may be arranged in rows along horizontal direction 120, and adjacent rows partially overlap (as illustrated by overlap 128) to form a tiled arrangement of pockets. For example, flexible layer 110-1 and flexible layer 110-2 may be subdivided into segments (such as segment 222) along the rows. Segments of flexible layer 110-1 corresponding to adjacent rows may be mechanically coupled, and segments of flexible layer 110-2 corresponding to adjacent rows may be mechanically coupled. While not shown in FIGS. 1 and 2, in some embodiments the overlap of the adjacent pockets may vary of outer surface 110.

Furthermore, fife-protection mechanism 110 may include an optional absorbing material in the cavities (such as optional absorbing material 224), which may keep the openings open, allowing the fluid to fill the cavities (i.e., which may allow the fluid to fill the cavities). For example, the absorbing material may include: a sponge, textile fabric, and/or fireproof fibers. For clarity, this optional absorbing material is not shown in cavity 222 in FIG. 2.

Note that fire-protection mechanism 100 may include optional lips (such as optional lip 226), proximate to the openings, which guide the fluid into the pockets. Furthermore, fire-protection mechanism 100 may include an optional reflective coating (such as optional reflective coating 228) disposed on outer surface 210. This reflective coating may reflect light having wavelengths in the infrared (such as wavelengths between 700 nm and 1 mm), which may maintain a temperature of the fluid.

Figure 3:
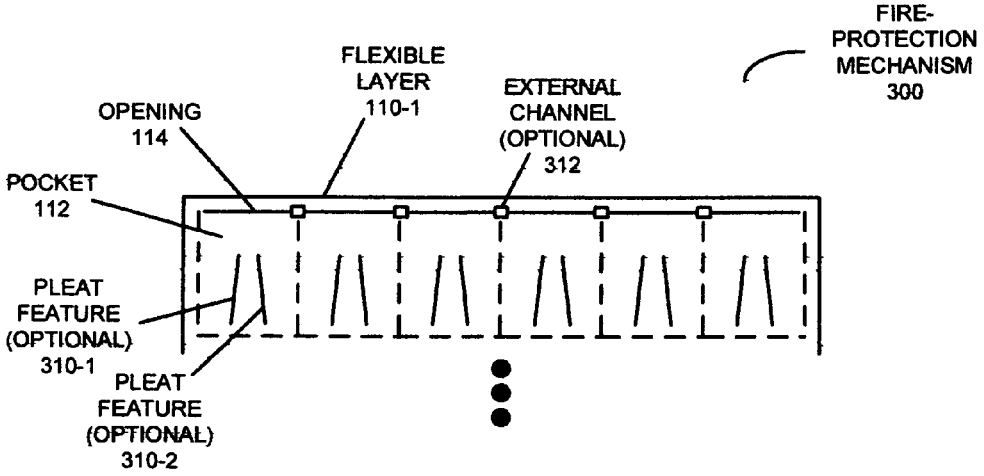
FIG. 3 is a block diagram illustrating a top view of a fire-protection mechanism in accordance with an embodiment of the present disclosure.

The fife-protection mechanism may include additional features to facilitate the filling of the cavities in the pocket. This is illustrated in FIG. 3, which presents a block diagram illustrating a top view of a fire-protection mechanism 300. In particular, flexible layer 110-1 may include optional pleat features 310 that allow the cavities to expand when the pockets are filled with the fluid. Additionally, fire-protection mechanism 300 may include optional external channels (such as optional external channel 312), located outside of outer surface 210 (FIG. 2) and outer surface 214 (FIG. 2), which couple the openings of at least a subset of the pockets (such as the pockets along a row). These external channels may distribute the fluid among at least the subset of the pockets.

Figure 4:
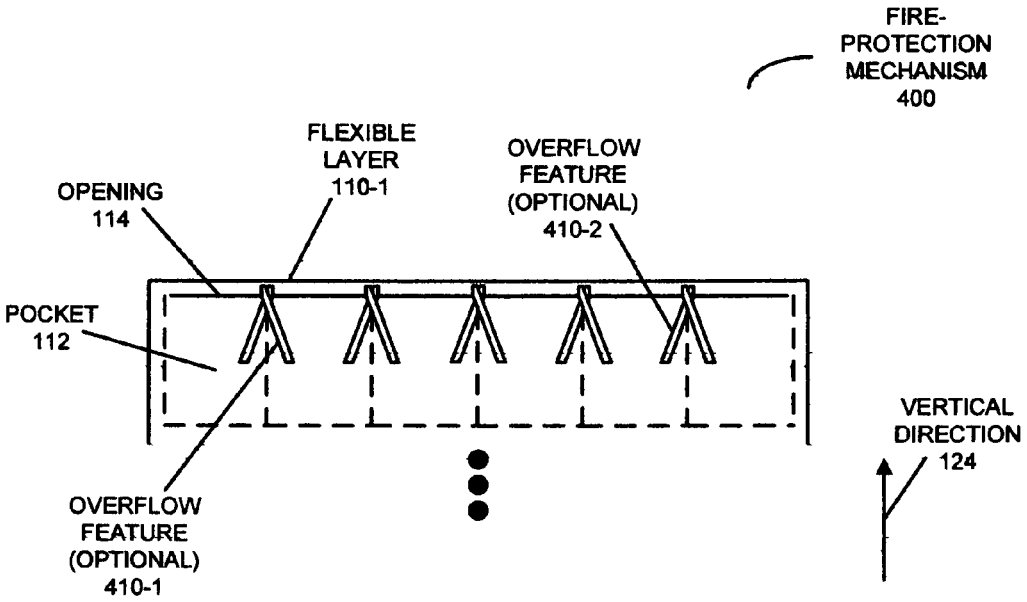
FIG. 4 is a block diagram illustrating a top view of a fire-protection mechanism in accordance with an embodiment of the present disclosure.

Alternatively or additionally, the fire-protection mechanism may include optional overflow features. This is shown in FIG. 4, which presents a block diagram illustrating a top view of a fire-protection mechanism 400. In particular, optional overflow features 410 may allow the fluid draining from an opening of a pocket that is above another pocket, along vertical direction 124, to be direct to the opening of the other pocket. For example, the fluid may cascade from one pocket to another as the pockets are filled. However, note that the dynamic or flow aspects of the embodiments of the fire-protection mechanism may facilitate the filling or the refilling of the cavities, as opposed to providing the fire protection (which may be based on the static presence of the fluid).

Figure 5:
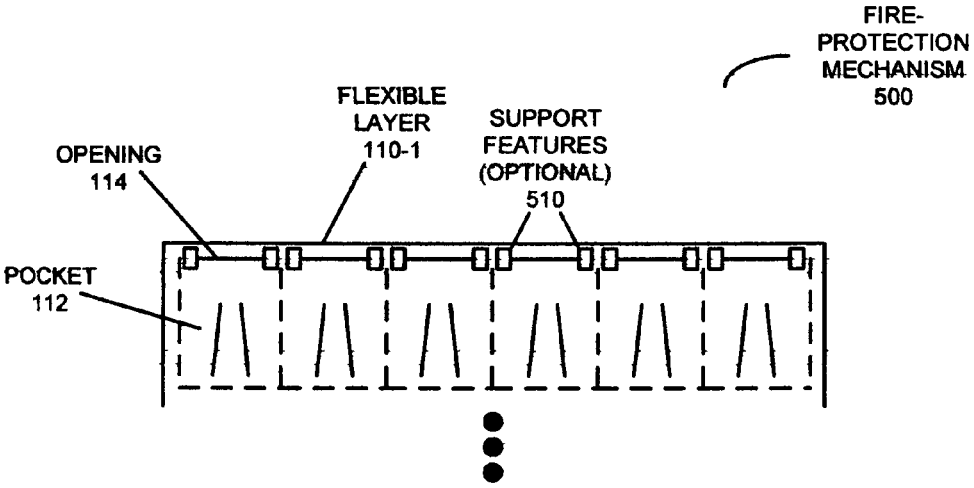
FIG. 5 is a block diagram illustrating a top view of a fire-protection mechanism in accordance with an embodiment of the present disclosure.

In some embodiments, the fire-protection mechanism includes optional support features proximate to corners of the openings to prevent tearing or failure of flexible layer 110-1. This is shown in FIG. 5 presents a block diagram illustrating a top view of afire-protection mechanism 500 with optional support features 510. Thus, the fire-protection mechanism may include features that allow the fire-protection mechanism to be disposed on or deployed over the object, i.e., the fire-protection mechanism may be a so-called 'fire blanket' for the object, as opposed to a so-called 'fire curtain' that subdivides an environment (such as the interior of a building) into a protected region and a region that may be exposed to fire.

Figure 7:
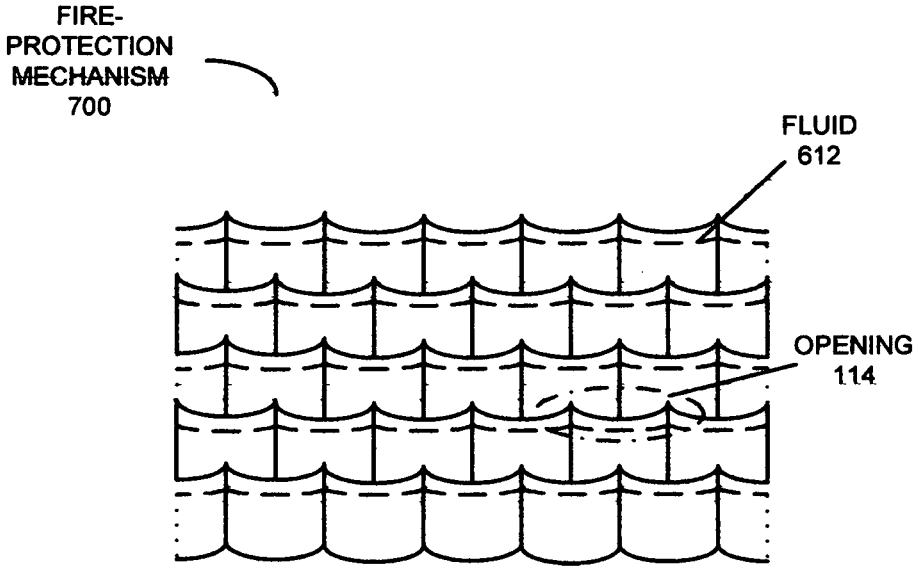
FIG. 7 is a drawing illustrating a fire-protection mechanism in accordance with an embodiment of the present disclosure.

In an exemplary embodiment, the fire-protection mechanism is used to protect an object in the event of high fire danger or a proximate fire, such as a wild fire and/or fire on an adjacent (or nearby) structure. For example, the fire-protection mechanism may be deployed over the roof of a building and the cavities defined by the pockets may be filled with fluid, such as water. This is shown in FIG. 6, which presents a block diagram illustrating a cross-sectional side view of protecting an object 610 using a fife-protection mechanism. Moreover, as shown in FIG. 7, which presents a drawing illustrating fire-protection mechanism 700, when deployed over object 610 (FIG. 6), the openings in fire-protection mechanism 700 (such as opening 114) may allow water (and, more generally, fluid 612) to flow into the pockets and to be held in place by gravity. Note that the openings may ensure that fluid 612 in the pockets is exposed to air. Thus, the pockets (or cavities) in fire-protection mechanism 700 may be partially enclosed.

Referring back to FIG. 6, the fire-protection mechanism may be deployed on the roof of object 610 by rolling the midline of the coiled fire-protection mechanism out along the apex or ridge of the roof, and then releasing two coiled rolls of the fire-protection mechanism so that gravity causes the fire-protection mechanism to unfurl along the roof at right angles to the midline and the apex of the roof. (Thus, in some embodiments, the fire-protection mechanism may be deployed by rolling it down the apex of the roof, and then unfolding it down the sides of the roof.) More generally, the fife-protection mechanism may be unfolded onto object 610. These operations may be performed by one or more individuals who do not require special training (in general, the fife-protection mechanism is easy to deploy). However, in other embodiments, an automated deployment mechanism (not shown) may perform these operations.

Note that before, during and/or after deployment of the fire-protection mechanism, the fire-protection mechanism may be secured in place. For example, the fire-protection mechanism may be secured using optional anchor features (such as optional anchor feature 132) and rope or ribbons. In particular, the rope may be passed through the optional anchor features and secured to anchors on object 610 and/or in the ground proximate to object 610. These optional anchor features may be proximate to edges 130 (FIG. 1). Alternatively or additionally, the rope or ribbons may be attached to the optional anchor features and, thus, included in the fire-protection mechanism. The rope or ribbons may be attached around a periphery of the fire-protection mechanism, and may be tossed over the roof of object 610 to allow the fire-protection mechanism to be pulled over and around object 610 without requiring an individual stand on the roof. In general, the optional anchor features may include: strings, ties, grommets, attached stiffeners, etc.

In some embodiments, at least some of the pockets include ballast or weights that are used to help secure the fire-protection mechanism on object 610. Thus, the pockets may be subdivided into fire-protection pockets and ballast pockets.

Additionally, in some embodiments optional support features 618 and 620 are used to protect the fire-protection mechanism from damage at corners or sharp features of object 610. These optional support features may be attached to (and, more generally, mechanically coupled to) the fire-protection mechanism or may separate from the fire-protection mechanism.

After the fire-protection mechanism has been deployed, the cavities in the fire-protection mechanism are filled with fluid (such as fluid 612). In general, a continuous fluid supply or fluid source is not needed when using the fire-protection mechanism. However, as noted previously, an optional external pump 614 and an optional hose 616 may be coupled to optional internal channel 138 (such as using, optional external coupling 642), and the fluid may be pumped into optional internal channel 138. This optional external pump may incorporate a tank or another water reservoir, which may in turn incorporate a capture mechanism for fluid flowing off the fire-protection mechanism. The fluid may flow through holes in optional internal channel 138 over the outer surface of flexible layer 110-1 and into the openings to fill the cavities in the pockets. Alternatively or additionally, a stream of fluid may be directed onto the outer surface of flexible layer 110-1 in order to fill the cavities in the pockets. For example, a stream of water from a hose may be sprayed on the outer surface to fill and/or to refill the cavities in the pockets (such as the water that has leaked and/or evaporated from the cavities). However, in some embodiments optional hose 616 fills the fire-protection mechanism with fluid via optional internal channels 116 and/or 118 (FIG. 1) without flowing fluid over the outer surface of flexible layer 110-1 (FIG. 1). Note that the weight of the fluid may also help secure the fire-protection mechanism on object 610.

In FIG. 6, note that the fire-protection mechanism has free-standing vertical portions that can be used to protect the sides of object 610 (as opposed to the roof). In general, the fire-protection mechanism may be single-sided or multi-sided to conform to different building configurations or shapes.

While a building having a roof with an apex is used as an illustration of the object in FIG. 6, in other embodiments the object may include: a building with a flat roof, a hill, the ground and, more generally, a surface.

In an exemplary embodiment the fire-protection mechanism reduces hazards posed by multiple, specific ignition hazards. In particular, primary ignition sources include radiant energy loads, direct contact with flames or extreme temperature gasses from the surrounding conflagration and burning objects and embers falling on the structure. In the exemplary embodiments for select hazards, the fire-protection mechanism has dimensions of 10×5 meter$^2$ with pockets having cavities filled with water to an aggregate thickness (in overlapping pockets) of 5 cm. In these embodiments, the water in the pockets may be static or may be supplied to the pockets using a water-distribution technique.

While providing protection from radiant energy that may cause ignition using the fire-protection mechanism, the heat flux needed to ignite the structure may first heat the water contained in the fire-protection mechanism, and then may boil the water away prior to the energy being transferred to the underlying structure, which may result in ignition. The combined effects of energy absorption (associated with increased water temperature) and energy, absorption from boiling away a static water supply in the fire-protection mechanism may provide several minutes of fire protection under radiant energy loads before the underlying structure is unprotected. Moreover, the protection may be extended indefinitely if the fire-protection mechanism being used has a water supply that refreshes the fire-protection mechanism with adequate volumes of water.

Moreover, while providing protection from convection energy transfer or direct structural contact with flames that may cause ignition using the fire-protection mechanism, the fire-protection interval may scale with the energy density of the flames. Consequently, the protection intervals can be compared to the radiant energy ignition example described previously.

Furthermore, while providing protection from ignition due to burning cinders and embers landing on the structure using the fire-protection mechanism, and assuming small ember sizes (such as a few grams each), the embers may be immediately quenched when they come in contact with the water in the filled pockets or they may bounce off the structure and the fire-protection mechanism (in which case the energy transfer is immaterial). Larger embers or smaller burning objects (such as small branches) may be in contact with the water contained in multiple pockets and the likelihood that the burning object is extinguished may be increased.

Additionally, while providing protection from ignition due to direct contact with large burning objects (such as burning trees) falling on the structure using the fire-protection mechanism, the fire-protection mechanism may provide momentary protection and water may flow to any depressions made by the falling burning objects, which may douse the flames.

In some embodiments, the fire-protection mechanism includes pneumatic channels that, when inflated, provide structural support (or rigidity) and/or automatically deploy the fire-protection mechanism on an object (such as a building). Thus, the pneumatic channels may not, per se, directly provide fire protection. Moreover, the fire-protection mechanism may be deployed in whole or in parts. For example, it may be easier to build and/or to deploy the fire-protection mechanism in segments or sections. By overlapping, tying or otherwise affixing the segments to each other, the pockets may be vertically aligned. When overlapped in this way, the weight of the fire-protection mechanism may help hold the inner or the sections underneath in place. Note that the fire-protection mechanism may include tabs in the segments that overlap into the pockets of the fire-protection mechanism that are underneath. Thus, segments of the fire-protection mechanism hung over the ends of a house may be held in place by segments hung over the roof peak.

Note that portions or sub-sections of the fire-protection mechanism may be used to go around chimneys and other roof obstructions on the object. These portions may have holes or features that allow the portion to fit to the roof obstruction. For example, a cowl may be deployed first with pockets to go around chimneys and/or pipes sticking out of a roof. This cowl may allow the main portion of the fire-protection mechanism to be deployed over the roof of a building and to provide protection right up to the chimney and/or pipes.

Figure 8:
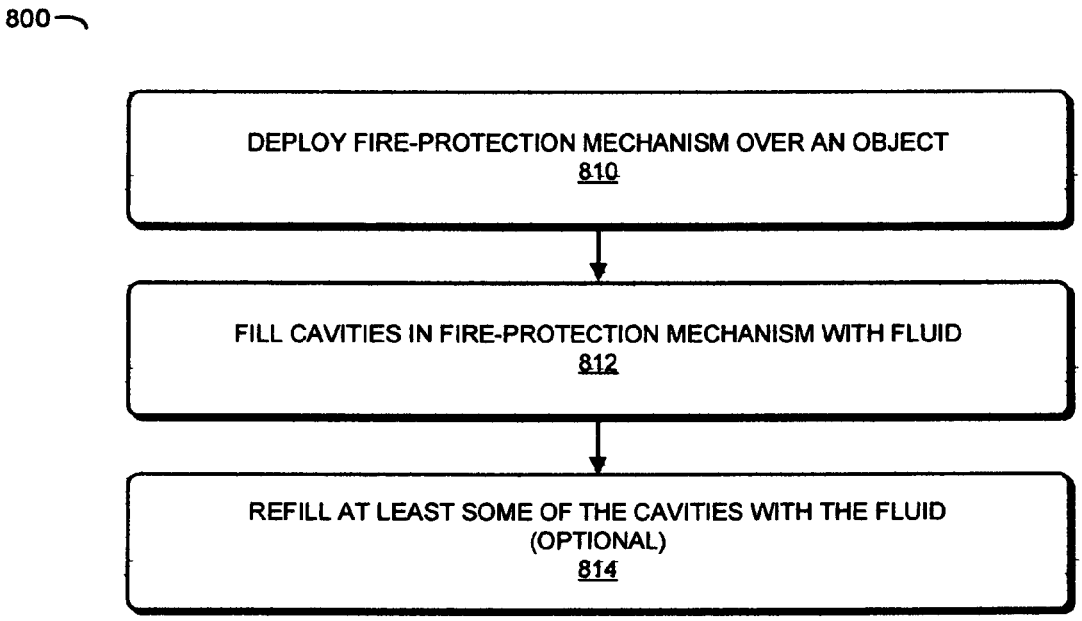
FIG. 8 is a flow chart illustrating a method for protecting an object using a fire-protection mechanism in accordance with an embodiment of the present disclosure.

We now describe embodiments of the method for protecting an object. In particular, FIG. 8 presents a flow chart illustrating a method 800 for protecting an object using a fire-protection mechanism, such as one of the preceding embodiments of the fire-protection mechanism in FIGS. 1-6. During this method, the fire-protection mechanism is deployed over an object (operation 810). Then, cavities in the fire-protection mechanism are filled with fluid (operation 812). Next, at least some of the cavities are refilled with the fluid (operation 814).

In some embodiments of method 800, there may be additional or fewer operations. Moreover, the order of the operations may be changed, and/or two or more operations may be combined into a single operation.

A wide variety of techniques and materials may be used to fabricate the fire-protection mechanism. For example, thin-film plastics may be used as a material and thin-film, thermal-bonding techniques applied in which two layers of plastic film are placed on top of each other and a welding device may apply a controlled temperature and pressure to bond two or more layers of film. In this example, a large plastic film sheet may have row after overlapping row of strips of plastic film bonded to it. In order for these rows to be bonded to the underlying base sheet and underlying layers of other strips, there rows may include bond lines to define the individual pockets, and may define internal water-distribution channels, as well as particular internal and external fluid-distribution features. In this example of thermal welding, multiple techniques may be used to prevent the projection of the features being formed in the current layer into prior layers where there may be overlap.

In this thin-film, thermal-bonding fabrication technique, the thermal welding mechanism may be continuous in nature so that the thermal bond between the layers is produced by rolling a heated wheel or another device of a particular geometry (which may include one or more simple cross sections, or may define more complex features, e.g., pockets, fluid distribution features, etc.) in order to bond the layers as the bonding mechanism provides heat and pressure over the time of travel as the device transverses the surface. This continuous welding technique may also be achieved by sliding a heated bar to define the welds between the layers.

Moreover, in the thin-film, thermal-bonding fabrication technique, the thermal welding mechanism may also be sequential in nature so that the thermal bond between the layers is produced by pressing a heated linear device or planer device with defined contact patterns to create the bonds between the layers of film. In particular, the thermal welding mechanism may be pressed against the film layers in a bonding operation so that heat and pressure act over time to bond the layers. These thermal welding mechanisms may create simple bonding patterns and may use multiple sequential bonding operations to define particular features, portions of features and/or sets of features. These thermal welding mechanisms may also create complex bonding patterns, where the thermal welding mechanism bonds an entire row in one bonding operation creating all the pockets, fluid distribution and/or other features in a single bonding operation.

Furthermore, in the thin-film, thermal-bonding fabrication technique, the temperatures, durations and pressures associated with creating the thermal bonds for particular films are understood by those of skill in the art of thermal bonding of plastics.

Additionally, in the thin-film, thermal-bonding fabrication technique care may be taken to not bond or otherwise transfer features or portions of features being fabricated in one layer to any overlapped layers that have already been fabricated in the series of sequential bonding operations. This may be achieved by placing an object in a previously formed pocket or feature of an overlapped layer so the formation of the pockets or features in subsequent layers do not bond all layers together. For example, an object that may interfere with thermal bonding to prior layers may include a piece of paper or card stock. This bond-inhibiting object may be inserted into pockets or features individually, in sets as part of a linear device (in which multiple bond-inhibiting objects are inserted into multiple pockets or features together along the row of pockets) or as part of a rotary device (in which the bond-inhibiting objects are inserted and removed from pockets or features in continues motion by the rotary device traversing the row of pockets).

Note that the thin-film thermal bonding technique is one illustration of many potential combinations of materials and manufacturing techniques. In another thin-film plastics example, instead of pockets defined by flexible sheets, the pockets may be made independently (similar to sandwich bags). These individual pockets may then be attached to and positioned between flexible sheets with openings. Moreover, different bonding techniques may also be used, such as tapes, adhesives, etc. In some embodiments, during the thin-film thermal bonding technique, the inner outer layers may be formed from one continuous sheet of plastic film, in which otherwise separately attached segments or strips (such as those described previously) may be formed by drawing up loops of the plastic film to form the segments and then creating the pockets and features as described previously.

The embodiments of the fire-protection mechanism may be fabricated using a wide variety of materials, including low-cost materials. Moreover, the fire-protection mechanism may not rely on the materials being fire proof or fire resistant (although the materials can be). The fire-protection mechanism may be made of layers that are non-porous and/or that have fixed or controlled porosity. Furthermore, the fire-protection mechanism may be made of non-absorbent and/or absorbent materials. For example, at least some of the layers of the fire-protection mechanism (such as layer 110-1 in FIG. 1) may be comprised of component layers with different absorption properties. Additionally, a layer may combine a fire-proof material with a non-porous material.

An embodiment of the fire-protection mechanism may be made for use on flat or nearly flat surfaces, in which pockets (such as pocket 112 in FIG. 1) act as open cups on a surface. The walls of the pockets may be formed to stand away from flexible layer 110 (FIG. 1), and fluid control in the horizontal and vertical directions may impact the distribution of water in the cups so that the cups fill to a proscribed level. In a similar way that the fire-protection mechanism disposed over an object with a sloped or vertical surface provides a controlled fluid supply to suppress ignition, this embodiment provides a controlled fluid supply to suppress ignition on a flat surface.

The fire-protection mechanism in the preceding embodiments may include fewer components or additional components. For example, the fire-protection mechanism may include features to control the amount of fluid in the pockets to reduce (or bound) roof loading. In particular, there may be one or more attachment points or lines between inner surface 212 (FIG. 2) and inner surface 216 (FIG. 2), and contained within the outline or area of a given pocket, which control or reduce: the potential volume of the given pocket when filled with the fluid and/or the potential thickness of the given pocket when filled with the fluid. In an exemplary embodiment, there is a connection or a coupling made in the middle of the given pocket from the front of the given pocket to the back, and the area of the given pocket is unchanged but the volume and thickness of the given pocket are reduced. A pocket with such a connection or coupling may resemble a pillow with a button sewn front to back in the middle of the pocket.

In some embodiments, a fluid-recycling mechanism may be deployed in conjunction with the fire-protection mechanism. For example, in FIG. 6 the fluid-recycling mechanism may catch fluid that leaks from the fire-protection mechanism, and may provide the fluid to optional external pump 614. In particular, the fluid-recycling mechanism may be deployed on the ground at the edge of the roof of object 610, and may provide this fluid to optional external pump 614, thereby providing a more-closed system.

Moreover, two or more components may be combined into a single component, and/or a position of one or more components may be changed.

In the preceding description, we refer to 'some embodiments.' Note that 'some embodiments' describes a subset of all of the possible embodiments, but does not always specify the same subset of embodiments.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. A fire-protection mechanism, comprising:

a first flexible layer having an outer surface and an inner surface, wherein the first flexible layer includes openings, defined by edges, between the outer surface and the inner surface, which are distributed over the outer surface;

a second flexible layer having an outer surface and an inner surface, wherein the second flexible layer is mechanically coupled to the first flexible layer to form multiple pockets in a vertical direction with multiple partially enclosed cavities defined by the inner surface of the first flexible layer, the Inner surface of the second flexible layer, and the openings;

wherein the openings are on a top edge of the pockets along a horizontal direction, the openings expose the partially enclosed cavities to air, and, for a given pocket, the openings extend over at least a substantial portion of a width of the given pocket along the horizontal direction;

wherein the openings are configured to allow fluid to flow into and fill the cavities;

wherein the cavities are configured to bold the fluid based on gravity; and wherein the static presence of the fluid provides fire protection based on the beat capacity and latent heat of the fluid.

2. The fire-protection mechanism of claim 1, wherein the fire-protection mechanism further includes internal channels, located between the inner surface of the first flexible layer and the inner surface of the second flexible layer, which couple pockets along rows in a horizontal direction of the fire-protection mechanism; and wherein the internal channels are configured to distribute the fluid among the pockets in a given row.

3. The fire-protection mechanism of claim 1, wherein the fire-protection mechanism further includes internal channels, located between the inner surface of the first flexible layer and the inner surface of the second flexible layer, which couple pockets along columns in a vertical direction of the fire-protection mechanism; and wherein the internal channels are configured to distribute the fluid among the pockets in a given column.

4. The fire-protection mechanism of claim 1, wherein the fire-protection mechanism further includes internal channels, located between the inner surface of the first flexible layer and the inner surface of the second flexible layer, which couple the pockets; and wherein the internal channels are configured to distribute the fluid among the pockets.

5. The fire-protection mechanism of claim 1, wherein the pockets are arranged in rows along a horizontal direction of the fire-protection mechanism; and wherein adjacent rows partially overlap to form a tiled arrangement of pockets.

6. The fire-protection mechanism of claim 5, wherein the first flexible layer and the second flexible layer are subdivided into segments along the rows;

wherein segments of the first flexible layer corresponding to adjacent rows are mechanically coupled; and wherein segments of the second flexible layer corresponding to adjacent rows are mechanically coupled.

7. The fire-protection mechanism of claim 1, Wherein the fire-protection mechanism is configured to be disposed on an object.

8. The fire-protection mechanism of claim 1, wherein the fire-protection mechanism includes anchoring features proximate to edges of the first flexible layer and the second flexible layer.

9. The fire-protection mechanism of claim 1, wherein at least some of the pockets have different aspect ratios between widths of the pockets along a horizontal direction of the fire-protection mechanism and lengths of the pockets along a vertical direction of the fire-protection mechanism.

10. The fire-protection mechanism of claim 1, wherein the width of the given pocket along the horizontal direction of the fire-protection mechanism is smaller than a length of the given pocket along a vertical direction of the fire-protection mechanism.

11. The tire-protection mechanism of claim 1, wherein aspect ratios, between widths of the pockets along a horizontal direction of the fire-protection mechanism and lengths of the pockets along a vertical direction of the fire-protection mechanism, vary over the fire-protection mechanism.

12. The fire-protection mechanism of claim 1, wherein the mechanical coupling includes one of: a thermal weld, an adhesive, and double-stick tape.

13. The fire-protection mechanism of claim 1, wherein the fire-protection mechanism includes an internal channel, located between the inner surface of the first flexible layer and the inner surface of the second flexible layer, along a midline of the fire-protection mechanism;

wherein fire-protection mechanism is configured to couple to an external source of the fluid and the internal channel is configured to convey the fluid;

wherein the first flexible layer includes holes, defined by edges, between the inner surface of the first flexible layer and the outer surface of the first flexible layer; and wherein the holes overlap with the internal channel.

14. The fire-protection mechanism of claim 1, wherein the first flexible layer includes pleat features that are configured to allow the cavities to expand when the pockets are filled with the fluid.

15. The fire-protection mechanism of claim 1, wherein the fire-protection mechanism further includes overflow features so that the fluid draining from an opening, of a pocket that is above another pocket, along a vertical direction of the fire-protection mechanism, is directed to the opening of the other pocket.

16. The fire-protection mechanism of claim 1, wherein the fire-protection mechanism further includes an absorbing material in the cavities configured to allow the fluid to flow into the cavities.

17. The fire-protection mechanism of claim 1, wherein the fire-protection mechanism further includes external channels, located outside of the outer surface of the first flexible layer and the outer surface of the second flexible layer, which couple the openings of at least a subset of the pockets; and wherein the external channels are configured to distribute the fluid among at least the subset of the pockets.

18. The fire-protection mechanism of claim 1, wherein the fire-protection mechanism further includes lips, proximate to the openings, which are configured to guide the fluid into the pockets.

19. The fire-protection mechanism of claim 1, wherein the fire-protection mechanism further includes support features proximate to corners of the openings.

20. The fire-protection mechanism of claim 1, wherein the fire-protection mechanism further includes a reflective coating disposed on the outer surface of the first flexible layer; and wherein the reflective coating is configured to reflect light having wavelengths in the infrared to maintain a temperature of the fluid.

* * * * *